United States Patent [19]

Sharlow

[11] 4,270,707

[45] Jun. 2, 1981

[54] TYPEWRITER RIBBON SPOOL CORE SHAFT ADAPTER

[75] Inventor: Roger C. Sharlow, Plano, Tex.

[73] Assignee: Liquid Paper Corporation, Dallas, Tex.

[21] Appl. No.: 62,013

[22] Filed: Jul. 30, 1979

[51] Int. Cl.[3] ..... B65H 19/04

[52] U.S. Cl. ..... 242/56.9

[58] Field of Search ..... 242/56.9, 68.3, 56.2, 242/68, 68.3, 67.1 R

[56] References Cited

U.S. PATENT DOCUMENTS

| | | | |
|---|---|---|---|
| 2,431,130 | 11/1947 | Lychansky | 242/56.9 |
| 2,798,677 | 7/1957 | Nicholson | 242/56.9 |
| 3,322,359 | 5/1967 | Dales | 242/56.9 X |
| 3,702,687 | 11/1972 | Hall | 242/56.9 |

*Primary Examiner*—Edward J. McCarthy

*Attorney, Agent, or Firm*—Richards, Harris & Medlock

[57] ABSTRACT

A system for driving a plurality of typewriter ribbon cores (80) having irregular apertures therethrough (150) includes a shaft (70) supported for rotation and a plurality of spacers (74) keyed to the shaft for rotation therewith. A plurality of adapters (72) are separated by the spacers and have a bore (170) therethrough for mating engagement on the shaft. The outer surface of the adapter corresponds to the irregular aperture through the ribbon core for receiving the core thereon. An inwardly directing force is applied on the outermost spacer such that the adapters and cores mounted thereon are engaged between adjacent spacers. This engagement force between the spacers and adapters imparts a constant rotational torque to the adapters and cores as the shaft spacers are rotated. Typewriter ribbon (R) is attached to each of the cores and is wound onto the core as the core is rotated with the shaft. Because the adapter and cores are not keyed to the shaft, they are free to rotate relative to the shaft when tension on the ribbon (R) produces a resistance torque greater than a predetermined limit.

24 Claims, 8 Drawing Figures

TYPEWRITER RIBBON SPOOL CORE SHAFT ADAPTER

TECHNICAL FIELD

The present invention relates to an adapter for mounting a typewriter ribbon spool on a take-up shaft.

BACKGROUND ART

Typewriter ribbon is normally wound on a core to produce a ribbon spool for use in a typewriter. One method of producing the individual typewriter ribbon spools includes the severing of a sheet of typewriter ribbon into a plurality of ribbons and attaching each ribbon to a spool core mounted for rotation on a take-up shaft. As the core is rotated, the ribbon is wound onto the core to form a spool of typewriter ribbon.

As the sheet of ribbon is divided into a plurality of ribbon strips, each strip is connected to one of the spool cores mounted on the take-up shaft so that a plurality of spools of ribbon are formed simultaneously. To eliminate problems resulting from differences between each of the spool cores and the ribbon wound thereon, the spool cores are not keyed to the shaft. Rather, each spool core is separated by a spacer which is keyed to the take-up shaft but slidable along the longitudinal length of the shaft. By applying an inwardly directed load to the endmost spacers, a desired friction is generated between the spacers and the typewriter ribbon cores so that the ribbon cores are driven by their engagement with the spacers keyed to the take-up shaft. In this way, a constant load may be applied to each of the ribbon cores with the cores being allowed to slip relative to the driving shaft when the load on the ribbon exceeds a predetermined limit. In this way, irregularities are avoided in the typewriter ribbon as it is wound onto the cores.

In prior art systems, the ribbon cores have normally had a circular aperture therethrough. In the ribbon take-up structure, a cylindrical shaft has been employed with a longitudinal keyway formed therein to accept a key extending interiorly from a spacer having a corresponding cylindrical aperture therethrough. The spacers are mounted on the shaft with the typewriter ribbon spool cores engaged onto the circular shaft separated by the spacers.

Because the typewriter ribbon spool cores have, in some circumstances, been formed with cylindrical apertures therethrough, accommodation of the cores in the above-described system has required no more than the mounting of the cores on the take-up shaft with spacers mounted therebetween. However, because the typewriter ribbon cores must have an aperture formed therethrough to mate with the particular typewriter mechanism on which the typewriter ribbon is to be mounted, the aperture in the core is not always cylindrical. Therefore, where the aperture in the typewriter ribbon core is irregular, as opposed to being cylindrical, the use of the typewriter ribbon take-up structure described above has not been usable, and the advantages of the system permitting a constant angular rotation driving torque for each of a plurality of typewriter ribbon spools on a single driven shaft is lost. Therefore, a need has arisen for a system to drive a plurality of typewriter ribbon spool cores while maintaining a constant angular torque on each spool core and permitting the independent slippage of each core relative to the drive shaft when the maximum drive torque is exceeded.

DISCLOSURE OF INVENTION

The present invention provides a system for the loading of typewriter ribbon simultaneously on a plurality of typewriter ribbon spool cores having irregular apertures therethrough. The present system permits the application of a constant torque force on each of the typewriter ribbon spool cores while being driven from a single shaft.

The present invention for driving a plurality of typewriter ribbon spool cores having irregular apertures therethrough includes a shaft supported for rotation and a plurality of spacers keyed to the shaft for rotation therewith. The spacers are slidable along the longitudinal length of the shaft. An adapter is provided having a bore therethrough for engagement on the shaft. Each adapter has an outer surface corresponding to the irregular aperture through the spool core and receives a spool core thereon. A plurality of adapters, each supporting a spool core thereon, are loaded onto the shaft and separated by the spacers. An inwardly directing force is applied on the outermost spacer such that the adapters and cores mounted thereon are engaged between adjacent spacers. This engagement force between the spacers and the adapters imparts a constant rotational torque to the adapters and cores as the shaft spacers are rotated. Typewriter ribbon tape is attached to each of the cores and is wound onto the core as the core is rotated with the shaft. Because the adapter and core are not keyed to the shaft, they are free to rotate relative to the shaft when tension on the ribbon produces a resistance torque greater than a predetermined limit. Thus, the typewriter ribbon is not subjected to tensile loading greater than predetermined values.

In accordance with another aspect of the invention, the adapter has a cross section characterized by a pair of semicircles each having a flat side facing inwardly and a curved opposite side facing outwardly. A middle brace is attached at its ends to the flat sides of the semicircle to join them one to the other.

In accordance with another embodiment of the invention, the adapter has a cross section characterized by two generally planar parallel sides and two outwardly curved sides interconnecting the opposite ends of the planar sides. The curved sides are in the path of a circle having its center substantially coincident with the center of a bore through the spool core.

In accordance with still another aspect of the invention, the system includes a first support arm having a bearing insert for engaging the lower portion of the shaft intermediate of its ends of support to support the shaft during rotation. A second support arm having a bearing insert therein engages the upper portion of the shaft above the point of support of the shaft by the first support arm. These support arms provide rigidity to the drive shaft which is substantially smaller than the prior art shaft because of the addition of the adapter used in the present invention.

DESCRIPTION OF THE DRAWINGS

For a more complete understanding of the present invention, and for further details and advantages thereof, reference is now made to the following Description taken in conjunction with the Accompanying Drawings, in which.

DETAILED DESCRIPTION OF PREFERRED EMBODIMENT

Figure 1:
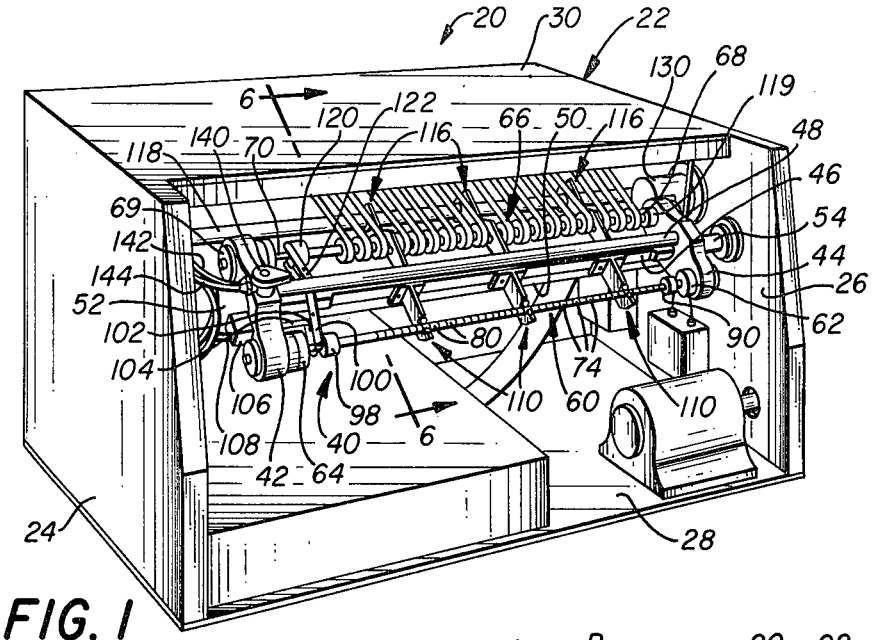
FIG. 1 is a perspective view of a typewriter ribbon winding apparatus embodying the present invention.

FIG. 1 is a perspective view of a typewriter ribbon winding apparatus 20 embodying the present invention. Apparatus 20 includes a housing 22 formed of sidewalls 24 and 26 separated by floor 28 and top 30. A ribbon winding unit 40 is mounted between sidewalls 24 and 26. Winding unit 40 includes opposed ribbon spool shaft hubs 42 and 44 separated by a generally rectangular central shaft 46 and two cylindrical shafts 48 and 50 positioned on opposite sides of shaft 46 and parallel thereto. Ribbon winding unit 40 is supported for rotation generally about the axis of central shaft 46 by shaft extensions 52 and 54 extending outwardly from hubs 42 and 44, respectively, substantially along the longitudinal axis of shaft 46. Shaft extensions 52 and 54 are mounted in appropriate bearings (not shown) positioned in sidewalls 24 and 26, respectively.

A ribbon spool shaft assembly 60 is received between a drive unit 62 on hub 44 and a receiving unit 64 of hub unit 42. Similarly, a ribbon spool shaft assembly 66 is received between a drive unit 68 of hub 44 and receiving unit 69 of hub 42.

Figure 2:
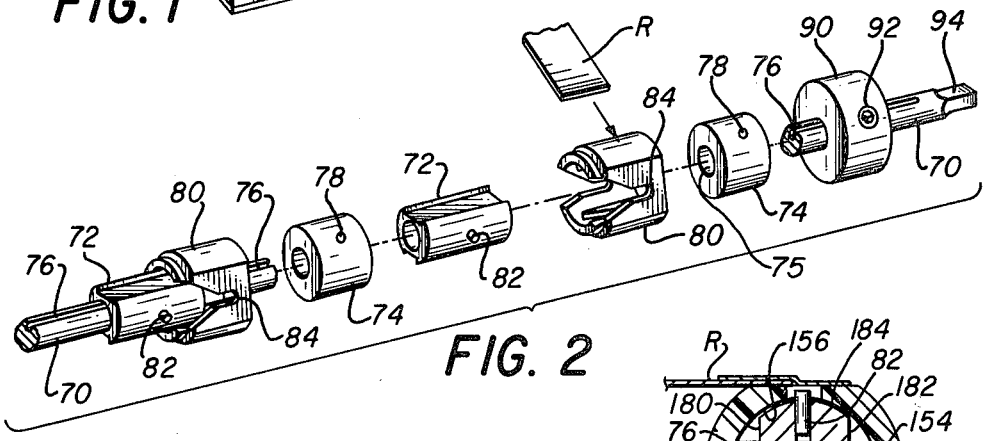
FIG. 2 is an exploded view of the ribbon shaft assembly of the present invention.

Referring to FIGS. 1 and 2, ribbon spool shaft assembly 60 includes a ribbon shaft 70 with a plurality of adapters 72 mounted thereon. Adapters 72 are separated by cylindrical spacers 74 having an aperture 75 therethrough for mounting on shaft 70. Shaft 70 has a continuous longitudinal keyway 76 formed therein. Spacers 74 have a key 78 extending radially inwardly into aperture 75 for engagement in keyway 76 to fix spacer 74 for rotation with shaft 70.

A ribbon spool core 80 is received on adapter 72 and is retained in position by radially projecting pin 82 extending from adapter 72 for engagement in cutout 84 in the sidewall of spool core 80. When in its mounted position, spool core 80 is also prevented from moving off of adapter 72 by spacer 74 positioned to the side of spool core 80 opposite pin 82 and adapter 72. As is shown in FIG. 2, ribbon R is attached to core 80 for winding thereon.

Referring to FIG. 2 is conjunction with FIG. 1, a collar 90 is mounted near one end of shaft 70 and is fixed for rotation therewith by set screw 92 positioned through collar 90 for engagement against shaft 70. The end 94 of shaft 70 adjacent collar 90 is formed with a square cross section for mating with drive unit 62 (FIG. 1).

Referring to FIG. 1, ribbon shaft assembly 60 is mounted with end 94 engaged in drive unit 62 and the end of shaft 70 opposite end 94 engaged in receiving unit 64. A plurality of ribbon spool cores 80 mounted on adapters 72 are positioned on shaft 70 each separated by a spacer 74. These components are maintained on shaft 70 by a movable collar 98 slidably receivable on the end of shaft 70 opposite end 94. Collar 98 is urged toward collar 90 on the opposite end of shaft 70 by compression arms 100 pinned at one end to shaft 46. A yoke 102 is mounted between the ends of arms 100 and communicates by way of a shaft 104 with pneumatic unit 106. By applying pressure through line 108 to pneumatic unit 106, yoke 102 is moved to force arms 100 against movable collar 98 to compress spacers 74 and spool cores 80 mounted between collars 98 and 90 on opposite ends of shaft 70.

Referring still to FIG. 1, ribbon shaft assembly 60 is supported at three points along its length by support arm assemblies 110. Assemblies 110 include an upper arm 112 mounted to a base 114 attached by appropriate means to shaft 46.

Ribbon shaft assembly 66 is identical to ribbon shaft assembly 60. Ribbon shaft assembly 66 is shown supported between drive unit 68 of hub 44 and receiving unit 69 of hub 42 with ribbon strips R in the process of being wound onto spool cores 80. As in the case of ribbon shaft assembly 60, ribbon shaft assembly 66 is composed of an inner shaft and a plurality of adapters and spool cores separated by spacers 74. A fixed collar 119 is mounted on the end of the shaft adjacent to drive unit 68 and a slidable collar 120 is mounted on the opposite end of shaft 70. A pair of tension arms 122 are pivotally supported from shaft 46 and engage collar 120 to apply a compressive force on spacers 74 and ribbon spool cores 80 as will be hereinafter discussed in greater detail.

The entire ribbon winding unit 40 is rotatable about shaft extensions 54 and 54 such that either ribbon shaft assembly 60 or ribbon shaft assembly 66 may be positioned to receive ribbon thereon. When the ribbon winding unit 40 is positioned as shown in FIG. 1, ribbon shaft assembly 66 is driven by a gear mounted from sidewall 26 in housing 130. This gear drives a complementary gear on hub 44 and in engagement with drive unit 68. Similarly, a drive gear is mounted on hub 44 for driving engagement with drive unit 62. Therefore, when the ribbon spool cores of ribbon shaft assembly 66 are loaded with ribbon, the ribbon winding unit is rotated about end shaft extensions 52 and 54 to position ribbon shaft assembly 60 with empty spool cores thereon in the position previously occupied by ribbon shaft assembly 66. Ribbon is attached to each of the spool cores 80 and as shaft 70 is rotated, ribbon is wound thereon. While ribbon is wound on spool cores 80, the ribbon shaft assembly 66 is withdrawn from winding unit 40 and the cores are removed and empty spool cores are loaded on the nonoperating ribbon shaft assembly.

When the ribbon shaft assembly is in the loading position, the shaft is supported from above by support arms 112 and from below by support arms 116. Support arms 116 are mounted from a rotatable shaft 118 supported between sidewalls 24 and 26. The ribbon shaft assembly is supported by engagement of the assembly by support arms 112 and 116 at one of the spacers intermediate of spools 80.

A lock mechanism normally fixes ribbon winding unit 40 from rotation about shaft extensions 52 and 54. Engagement of release lever 140 permits the rotation of ribbon winding unit 40. Release lever 140 also operates the flow of air through lines 142 and 144 for the control of lower support arms 116. As release lever 140 is engaged, air is directed through line 142 to one face of a piston valve (not shown) connected to shaft 118. Communication of air pressure to the valve causes the movement of the piston and rotation of shaft 118 away from the ribbon shaft assembly to permit the rotation of the ribbon winding unit 40. When the winding unit 40 is in position after rotation, engagement of release lever 140 causes the communication of compressed air through line 144 to operate on the piston valve to rotate shaft 118 in its support position shown in FIG. 1.

During operation of the unit, the drive force from shaft 70 is communicated to spool cores 80 by surface contact between spacers 74 and spool cores 80. As can be appreciated from a review of the components illustrated in FIG. 2, and as has been described above, spacers 74 are keyed to shaft 70 and rotate therewith. Spool cores 80, mounted for rotation on adapters 72, are not keyed to shaft 70 but rotated as a result of the rotation of spacers 74 on opposite sides thereof. Spacers 74 are forced into engagement with spool cores 80 by the compression exerted thereon by arms 100 and 122 engaging slidable collars 98 and 120 of shaft assemblies 60 and 66, respectively. Ribbon spool cores 80 are slightly longer in length than adapters 72 and therefore as the components on the shaft assemblies are compressed along the longitudinal axis of shaft 70, engagement occurs between the spacers and the spool cores.

By selectively controlling the force applied by arms 100 and 122, the drive force imparted to spool cores 80 before relative rotation occurs between the cores and shaft 70 can be accurately controlled. This is highly significant because of the need to permit relative rotation between spool cores 80 and shaft 70 to accomplish evenly wound spools of ribbon without binding, stretching or breaking the various ribbon elements being loaded onto the cores.

Figure 3:
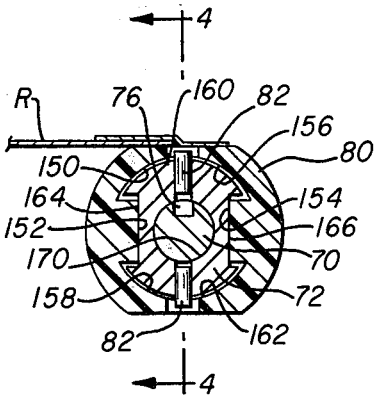
FIG. 3 is a section view of the ribbon shaft assembly of FIG. 2 in its assembled form.
Figure 4:
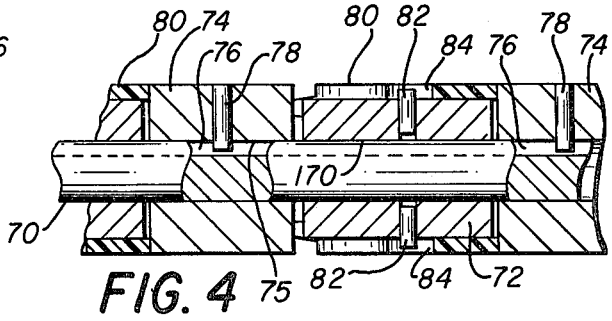
FIG. 4 is a section view taken along lines 4—4 of FIG. 3.

As can be seen in FIGS. 3 and 4, ribbon spool core 80 of the present invention has an irregular inner bore therethrough. Specifically, spool core 80 has a substantially circular inner bore 150 with two opposing inwardly protruding radial steps 152 and 154 dividing the bore into opposing cylindrical surfaces 156 and 158 on opposite sides of steps 152 and 154. To accommodate bore 150 of spool core 80, adapter 72 has an outer geometry including two opposing domes 160 and 162 corresponding to cylindrical surfaces 156 and 158 with keyways 164 and 166 formed therebetween to receive steps 152 and 154, respectively, of spool 80.

Adapter 72 has a central cylindrical bore 170 formed therethrough to receive shaft 70. FIGS. 3 and 4 also show in more detail pin 82 extending from adapter 72 engaging cutout 84 of spool core 80. As is shown in FIG. 3, a pin 82 extends from both sides of adapter 72 for engagement into opposed cutouts 84 of spool core 80.

Figure 5:
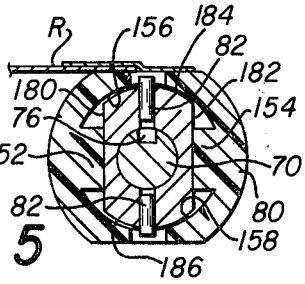
FIG. 5 is a section view of an alternative embodiment of the ribbon shaft assembly illustrated in FIG. 3.

FIG. 5 discloses an alternative embodiment of adapter 72 wherein like numerals represent the same or corresponding parts. In this embodiment, the adapter has flat opposed surfaces 180 and 182 corresponding to the inwardly facing surfaces of steps 152 and 154, respectively, with curved surfaces 184 and 186 corresponding to cylindrical surfaces 156 and 158 of spool core 80.

The present invention provides a spool adapter capable of receiving the spool of the present invention having the irregular bore therein while permitting the use of a shaft therethrough so that each spool may be permitted, as required, to rotate relative to the support shaft thereon. However, because the typewriter spool core 80 must have a predetermined outer diameter, an inner bore for mating engagement on specific typewriter drive mechanisms, the use of an adapter within the spool bore and the requirement that a cylindrical shaft be insertable through the adapter without engagement with the spool dictates the use of a relatively small diameter shaft. As a result, a plurality of support structures positioned along the longitudinal length of the ribbon shaft assembly make possible the use of a very small shaft diameter over a relatively long length for receiving many spools of ribbon thereon.

Figure 6:
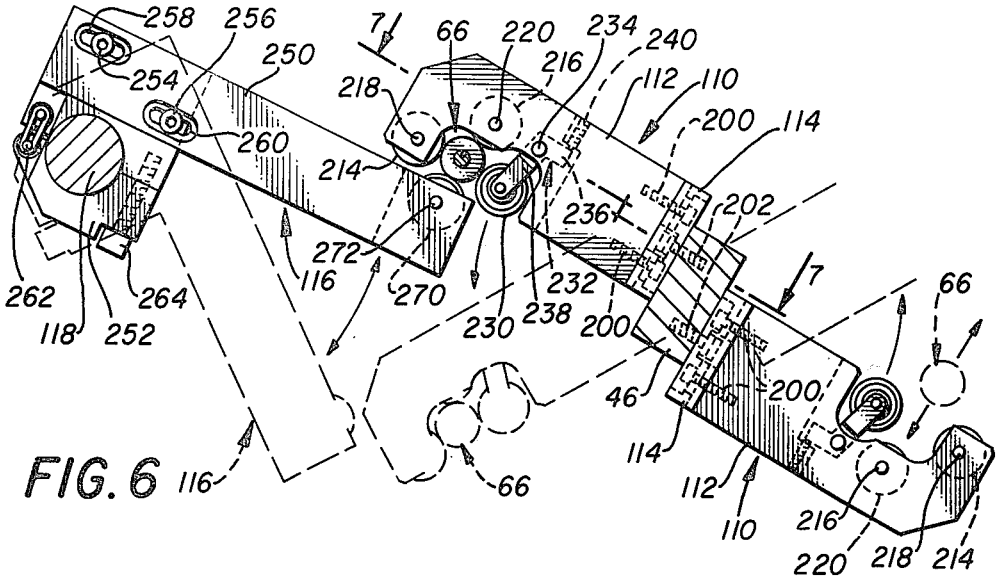
FIG. 6 is a side elevation of the upper and lower support arm assemblies of the present invention.
Figure 7:
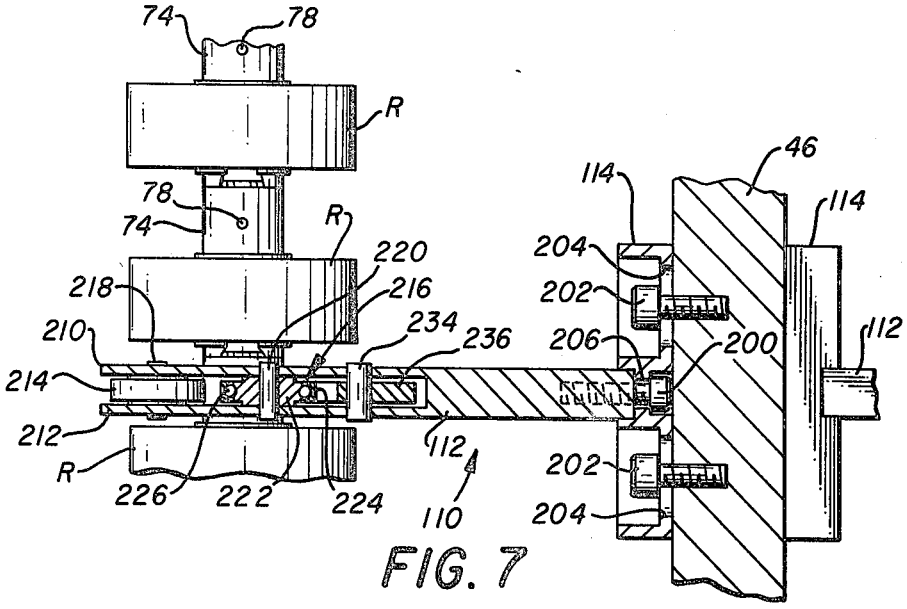
FIG. 7 is a section view taken along lines 7—7 of FIG. 6.

FIGS. 6 and 7 illustrate the components of the upper support arm assembly and lower support arm assembly in greater detail. Upper support arm assembly 110 includes an upper support arm 112 mounted to a base 114 by screws 200. Base 114 is mounted to central shaft 46 by appropriate screws 202 extending through slots 204 in base 114. Slots 204 are formed parallel to the longitudinal axis of central shaft 46 and permit the adjustment of upper support arm assembly 110 relative to the shaft. Similarly, screws 200 attach base 114 to upper support arm 112 through a slot 206 permitting adjustment of arm 112 in a plane perpendicular to the longitudinal axis of central shaft 46.

Referring to FIGS. 6 and 7, each upper support arm assembly 110 is formed with a pair of parallel plates 210 and 212 at the end remote from base 114. Plates 210 and 212 support a pair of stationary rollers 214 and 216 therebetween, and rollers 214 and 216 are supported for rotation on shafts 218 and 220, respectively. These rollers are standard roller bearings. As seen in FIG. 7, roller 216 has an inner ring 222 engaged on shaft 220 and an outer ring 224 rotatable relative to inner ring 222 over ball bearings 226. Roller 214 is of a similar construction.

Upper support arm 112 also supports a third roller 230 (FIG. 6) mounted on arm 232 pivotally connected to arm 112 by a pin 234. Arm 232 has a foot portion 236 extending at an angle from a roller support portion 238. Foot portion 236 engages a ball and spring assembly 240 mounted in upper support arm 112. As can be seen in FIG. 6, the arrangement of rollers 214, 216 and 230 are spaced to receive spacer 74 therebetween to secure shaft 70 within spacer 74 into position between the three rollers. With spacer 74 positioned between rollers 214, 216 and 230 as shown in FIG. 6, ball and spring assembly 240 is slightly compressed to force roller 230 against spacer 74 and spacer 74 into engagement with rollers 214 and 216. As a result, spacer 74 may be inserted between rollers 214, 216 and 230 and retained therebetween by the operation of ball and spring assembly 240 and the resulting force applied to roller 230.

When a ribbon shaft assembly is positioned in the loading position such as the position of ribbon shaft assembly 66 in FIGS. 1 and 6, additional support is provided to the shaft assembly by lower support arm assemblies 116. Each lower support arm assembly includes a lower support arm 250 adjustably mounted to a bar clamp assembly 252 by screws 254 and 256 mounted through slots 258 and 260, respectively, in arm 250. Bar clamp assembly 252 is secured around rotatable shaft 118 by appropriate fitting 262 and bolt 264. A support roller 270 is supported at the end of lower support arm 250 on an axis 272. As is shown in FIG. 6, lower support arm 250 may be rotated about shaft 118 to engage roller 270 against spacer 74 of ribbon shaft assembly 66. The presence of lower support arm 250 and the engagement of roller 270 against spacer 74 of ribbon shaft assembly 66 provides additional support to the shaft not provided by spring loaded roller 230.

As can be seen in FIG. 6, a pair of upper support arm assemblies 110 are mounted on opposite sides of central shaft 46. After the spool cores on ribbon shaft assembly 66 have been loaded, lower support arm assembly 116 is rotated downwardly in a clockwise direction as shown in phantom in FIG. 6 to permit the counterclockwise rotation of shaft 46 to position a second ribbon shaft assembly in the loading position. Lower support arm assembly 116 is then rotated in a counterclockwise position to engage roller 270 against spacer 74 to trap the spacer between rollers 214, 216 and 270. As can be appreciated from a review of FIG. 6, the positioning of these three rollers provides contact of the spacer at spaced points about its circumference. Although roller 230 may still be in engagement with spacer 74, the support provided by roller 230 is minimal compared to that support provided by roller 270.

Figure 8:
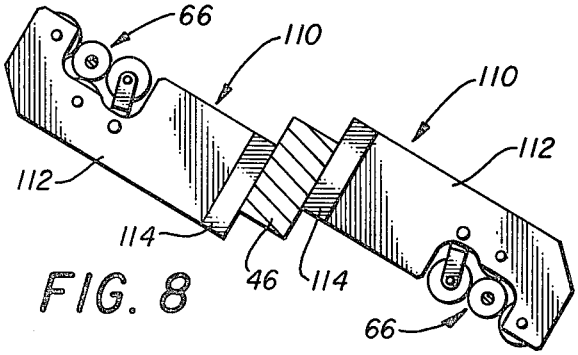
FIG. 8 is an alternative embodiment of the support arm assemblies illustrated in FIGS. 6 and 7.

FIG. 8 illustrates an alternative embodiment of the arrangement illustrated in FIGS. 1–7 which eliminates the use of lower support arm assembly 116. In the embodiment illustrated in FIG. 8, support arm assembly 110 is inverted such that when the ribbon shaft assembly is in the load position, such as ribbon shaft assembly 66 illustrated in FIG. 8, support is provided between rollers 214, 216 and 230. In this embodiment, support arm assembly 116 may be eliminated because of the result of the spring action of roller 230 to engage the shaft assembly between the three rollers positioned to one side and below the shaft assembly rather than above as illustrated in FIGS. 6 and 7.

The present invention, therefore, provides a shaft adapter for use with a ribbon spool core having an irregular bore therethrough permitting the use of an adapter and a shaft therethrough allowing for rotation of the spool relative to the shaft during loading of ribbon on the spool. As a result, the present system accommodates spool cores having irregular bores therethrough while permitting the control of the driving force applied to the spool to assure even and continuous loading of the ribbon on the spool core. Further, the present invention provides a unique arrangement for providing support to the ribbon shaft assembly so that a plurality of ribbons may be loaded simultaneously on a single shaft assembly.

Although preferred embodiments of the invention have been described in the foregoing detailed description and illustrated in the accompanying drawings, it will be understood that the invention is not limited to the embodiments disclosed, but is capable of numerous rearrangements, modifications and substitutions of parts and elements without departing from the spirit of the invention. The present invention is therefore intended to encompass such rearrangements, modifications and substitutions of parts and elements as fall within the scope of the appended claims.

I claim:

1. A system for driving a plurality of typewriter ribbon spool cores having irregular apertures therethrough, comprising:

a shaft supported for rotation, a plurality of spacers keyed to said shaft for rotation therewith, and a plurality of adapters separated by said spacers and having a bore therethrough for mating engagement on said shaft and an outer surface corresponding to the irregular aperture through the spool core for receiving the core thereon.

2. The system according to claim 1 further comprising:

force means for applying an inwardly directed force along the axis of said shaft to engage said spacers against said adapters to cause said adapters to rotate with said spacers as said spacers rotate with said shaft.

3. The system according to claim 1 where said adapters have a cross section characterized by a substantially cylindrical outer surface with opposed keyways formed in opposite sides of said surface.

4. The system according to claim 3 wherein said cylindrical outer surface of said adapter has its boundary in a circle with its center coincident with the axis of the bore through said adapter.

5. The system according to claim 1 wherein said adapters have a cross section characterized by four sides with two generally planar oppositely facing parallel sides and two oppositely facing curvilinear sides interconnecting the opposite ends of the planar sides.

6. The system according to claim 5 wherein said two curvilinear sides of said adapter have their boundary in a circle with its center coincident with the axis of the bore through said adapter.

7. The system according to claim 1 further comprising:

a first support arm having a plurality of rollers for engagement with one of said spacers during rotation thereof to support said shaft.

8. The system according to claim 7 further comprising:

a plurality of first support arms mounted for engagement with spacers mounted on said shaft at spaced intervals along the length of said shaft to provide support to said shaft along its longitudinal axis.

9. The system according to claim 7 wherein said support arm has two fixed rollers and a movable roller biased toward said fixed rollers, said rollers being positioned for receiving one of said spacers therebetween and for engagement against the periphery of said spacer.

10. The system according to claim 9 wherein said movable roller is movable on an arm pivotally supported from said support arm and further comprising a spring means engaging said movable arm for biasing said movable arm and movable roller toward said fixed rollers.

11. The system according to claim 7 further comprising:

a second support arm having a roller thereon for engaging said one spacer engaged by said first support arm to provide additional support to said shaft.

12. In a system for driving a plurality of typewriter ribbon spool cores having an irregular aperture therethrough on a rod engaging the cores between spacers keyed to the rod for rotation therewith, an adapter for mating the cores to the rods comprising:

a core insert having a bore therethrough for mating engagement on the shaft between the spacers, said insert having an outer surface corresponding with the irregular aperture through the spool core for receiving the core thereon.

13. The system according to claim 12 wherein said insert has a cross section characterized by a substantially cylindrical outer surface with opposed keyways formed in opposite sides of said surface.

14. The system according to claim 13 wherein said cylindrical outer surface of said insert has its boundary in a circle with its center coincident with the axis of the bore through said insert.

15. The system according to claim 12 wherein said insert has a cross section characterized by four sides with two generally planar oppositely facing parallel sides and two oppositely facing curvilinear sides interconnecting the opposite ends of the planar sides.

16. The system according to claim 15 wherein said two curvilinear sides of said insert have their boundary in a circle with its center coincident with the axis of the bore through said insert.

17. The system according to claim 12 further comprising:

a plurality of first support arms mounted for engagement with spacers mounted on said shaft at spaced intervals along the length of said shaft to provide support to said shaft along its longitudinal axis.

18. The system according to claim 12 further comprising:

a first support arm having a plurality of rollers for engagement with one of said spacers during rotation thereof to support said shaft.

19. The system according to claim 18 wherein said support arm has two fixed rollers and a movable roller biased toward said fixed rollers, said rollers being positioned for receiving one of said spacers therebetween and for engagement against the periphery of said spacer.

20. The system according to claim 19 wherein said movable roller is movable on an arm pivotally supported from said support arm and further comprising a spring means engaging said movable arm for biasing said movable arm and movable roller toward said fixed rollers.

21. The system according to claim 12 further comprising:

a second support arm having a roller thereon for engaging said one spacer engaged by said first support arm to provide additional support to said shaft.

22. In an apparatus for driving a plurality of typewriter ribbon spool cores on a shaft, a shaft support comprising:

a first support arm having a pair of fixed rollers and a movable roller mounted thereon for engagement with said shaft during rotation thereof, said rollers being positioned for receiving said shaft therebetween and for engagement against the periphery of said shaft.

23. The apparatus according to claim 22 wherein said movable roller is movable on an arm pivotally supported from said support arm and further comprising a spring means engaging said movable arm for biasing said movable arm and movable roller toward said fixed rollers.

24. The apparatus according to claim 22 further comprising:

a second support arm having a roller thereon for engaging said shaft to provide additional support to said shaft.

* * * * *